United States Patent [19]

Enomoto et al.

[11] 4,192,728

[45] Mar. 11, 1980

[54] METHOD FOR SUPPLYING POWDER INTO A COATING TANK AND ITS APPARATUS

[75] Inventors: Kunio Enomoto, Kawagoe; Uhee Kikuchi, Sayama; Masanori Kobori, Kawagoe; Suguru Kimura, Sayama; Satoru Kamiyama, Tokyo; Nobuaki Todoroki, Warabi; Jun-ichi Yasukawa, Chigasaki, all of Japan

[73] Assignees: Taikisha Ltd.; Honda Motor Co., Ltd., both of Tokyo; Shinto Paint Co., Ltd., Amagasaki, all of Japan

[21] Appl. No.: 941,456

[22] Filed: Sep. 12, 1978

[51] Int. Cl.[2] ..... C25D 13/24; C25D 15/00; C25D 17/00

[52] U.S. Cl. ..... 204/181 R; 204/181 C; 204/299 EC; 204/300 EC

[58] Field of Search ..... 204/181 R, 300 EC, 299 EC

[56] References Cited

U.S. PATENT DOCUMENTS

| | | | |
|---|---|---|---|
| 3,499,828 | 3/1970 | Vittorio | 204/299 EC |
| 3,679,615 | 7/1972 | Gilchrist | 204/181 R |
| 3,935,085 | 1/1976 | Baker et al. | 204/181 R |

FOREIGN PATENT DOCUMENTS

| | | | |
|---|---|---|---|
| 1157974 | 7/1969 | United Kingdom | 204/181 R |

*Primary Examiner*—Howard S. Williams

*Attorney, Agent, or Firm*—Frishauf, Holtz, Goodman & Woodward

[57] ABSTRACT

A method for supplying powder into a coating tank for electrophoretic powder coating comprises a first step for taking out a specified amount of plating bath of which the powder contained therein is reduced as a result of coating work, a second step in which the powder of much the same amount as the reduced amount of the powder is supplied to the plating bath taken out while the plating bath is being agitated to disperse the powder in the plating bath (the first dispersion) to form supplementary plating bath, a third step including the step for second dispersion of the powder in which the powder contained in the supplementary plating bath is further uniformly dispersed and a step for aging the supplementary plating bath with the dispersed powder, and a fourth step for supplying to the coating tank sufficiently aged supplementary plating bath which is obtained from the third step and has a high density of powder which is substantially uniformly dispersed in the supplementary plating bath, and an apparatus is one for executing that method.

4 Claims, 1 Drawing Figure

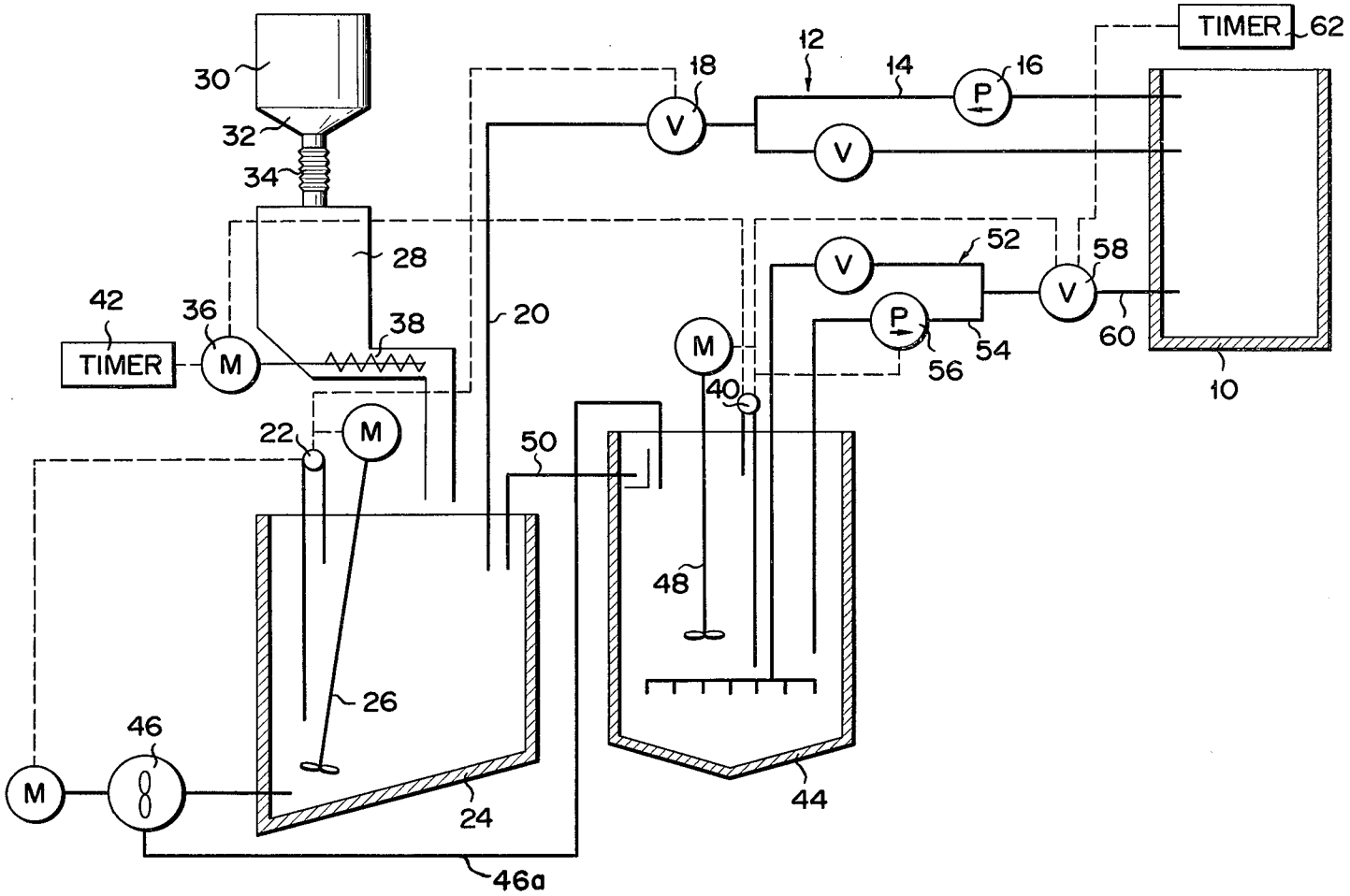
TIMER
62
10
58
60
16
52
54
56
14
12
18
44
40
48
50
20
46a
24
28
38
26
22
30
32
34
36
42
46

METHOD FOR SUPPLYING POWDER INTO A COATING TANK AND ITS APPARATUS

BACKGROUND OF THE INVENTION

The invention relates to a method for supplying powder to a coating tank for electrophoretic powder coating and an apparatus for excuting the method.

Recently, an electrophoretic powder coating method, which is generally called an EPC method, has been developed and has remarkably improved the coating technique. The EPC method is the electrophoretic coating of cationic type in which a combination of cataphoresis, electrolysis, electric separatinon and electroosmose is used for forming a coating layer on the surface of an article, as in the conventional anionic type electrophoretic coating method. One of the differences of the EPC method from the conventional anionic type electrophoretic coating method is to use coating material in which insoluble powder is suspended and dispersed in diluted solution of water-soluble binder resin (cationic binder). Another difference is that a DC voltage is applied between an article to be coated and an electrode immersed in the plating bath in order that the article serves as a cathode and the electrode an anode. For this, the coating layer formed on the surface of the article is composed of cationic binder resin and the powder. The EPC method offers many advantages in the following. (a) A thick coating layer may be formed for a short time, e.g. for several seconds. (b) The thickness of the coating is adjustable at will. (c) No elution of the metal from the article is occurs, because the coating is excuted by means of cationic type electrophoretic coating. (d) The coating layer formed is excellent in tightness and corrosion resistance. (e) The coating work is hygienic one wiht no harm by solvent and without possibility of explosion by dust. (f) Powder may be collected approximately at 100%.

In the EPC method, the powder contained in the plating bath is gradually consumed as the coating work progresses, with the result that the ratio of the amounts between the powder and binder in plating bath changes. When the ratio falls below a predetermined value, the coating quality deteriorates. Therefore, it is necessary to supply powder of the amount corresponding to the consumed powder amount to the plating bath, in mid course of the coating work. In this case, however, the powder supplied gathers into lumps so that it is hard to disperse into the plating bath. Even if it is dispersed, aging of the powder and binder is insufficient in the plating bath. Many attempts to solve such problems have been made but unsuccessful.

SUMMARY OF THE INVENTION

Accordingly, an object of the invention is to provide a method for supplying powder to a coating tank for electrophoretic powder coating and its apparatus in which, when powder is supplied into the plating bath received in the coating tank, the powder supplied is substantially uniformly dispersed in the plating bath and the powder and binder in the plating bath are sufficiently aged.

To attain this object, a method of this invention comprises first step for taking out a given amount of plating bath in a coating tank of which the powder contained therein is reduced as a result of coating work, a second step in which the powder of much the same amount as the reduced amount of the powder is supplied to the plating bath taken out while the plating bath is being agitated to disperse the powder in the plating bath (the first dispersion) to form supplementary plating bath, a third step including the step for second dispersion of the powder in which the powder contained in the supplementary plating bath is further uniformly dispersed and a step for aging the supplementary plating bath with the dispersed powder, and a fourth step for supplying to the coating tank sufficiently aged supplementary bath which is obtained from the third step and has a high density of powder which is substantially uniformly dispersed in the supplementary plating bath; and an apparatus of this invention comprises a plating bath taking-out means for taking out a suitable amount of plating bath in a coating tank of which the powder received therein is reduced as a result of coating work, a mixing tank for receiving plating bath taken out, an agitator provided on the mixing tank, a powder supply unit for gradually supplying powder of the amount to be supplied into the plating bath in the mixing tank to form a supplementary plating bath, a powder dispersion unit for taking out the supplementary plating bath in the mixing tank and more uniformly dispersing the powder contained in the supplementary plating bath, an aging tank which receives the supplementary plating bath delivered through the powder dispersion unit and reserves the supplementary plating bath while agitating the same, so as to sufficiently aging the powder in the supplementaly plating bath, and a duct for supplying supplementaly plating bath from the aging tank into the coating tank at a predetermined time point.

According to the invention, there is formed supplementary plating bath containing powder sufficiently uniformly dispersed and aged. Accordingly, the supplementary plating bath supplied into the coating tank does not gather into lumps, with well aged condition. Therefore, the invention is well adapted for a continuous coating operation by the electrophoretic powder coating method.

Other objects and features of the invention will be apparent from the following description taken in connection with the accompanying drawing.

BRIEF DESCRIPTION OF THE DRAWING

This single FIGURE is a schematic diagram of an appratus of this invention.

DETAILED DESCRIPTION OF PREFERRED EMBODIMENT

An apparatus for supplying powder to a coating tank for an electrophoretic powder coating according to the invention will be described. The method for supplying powder to a coating tank according to the invention will be seen from the discription relating to the operation of the powder supply unit. In the accompanying drawing, a broken line is used to designate a wire connection of an electrical control.

As shown, a coating tank designated by reference numeral 10 is coupled with a plating bath take-out duct 12 for taking out a part of plating bath from the coating tank 10. The duct 12 comprises a circulating path 14 connecting to the coating tank 10, a pump 16 for taking out plating bath is provided on the circulating path, an automatic valve 18 provided on the circulating path 14, and a take-out port 20 elongating from the automatic valve 18. The automatic valve 18 is opened and closed by a signal delivered from a level detector 22 to be described later. Reference numeral 24 is a mixing tank with a relatively small capacity for receiving plating bath delivered from the take-out port 20. The mixing tank 24 is provided with an agitator 26 for agitating plating bath therein. When the plating bath in the mixing tank 24 exceeds a given lower level, the level detector 22 produces an output signal and the agitator 26 responds to the output signal to rotate for agitating the plating bath. A powder supply unit 28 provided above the mixing tank 24 supplies a specified amount of powder to the mixing tank 24. The powder supply unit 28 supplies supplementary powder down through a guide 34 from a hopper 32 gradually into the mixing tank 24 by the operation of a feed screw 38 driven by a motor 36. In this specification, a supplementary plating bath means a plating bath containing supplementary powder with a high density. The motor 36 rotates in response to a signal from the level detector 40 to be described later and the rotation of the motor 36 lasts during a period given by a timer 42. A powder dispersing unit 46 receives supplementary plating bath from the lower part of the mixing tank 24, sufficiently disperses powder and feeds it to an ageing tank 44. The aging tank 44 is provided with an agitator 48 for agitating the supplementary plating bath inside the aging tank and the level detector 40. When the level of the supplementary plating bath exceeds a predetermined lower limit level, the agitator 48 operates in response to a signal from the level detector 40 and agitates the supplementary plating bath. An overflow path 50 is provided on the upper part of the aging tank 44 and provides a path through which supplementary plating bath overflowed from the tank 44 returns to the mixing tank 24.

Reference numeral 52 designates a supply means for feeding the supplementary plating bath in the aging tank 44 to the coating tank 10, at a given time point. The supply means 52 includes a circulating path 54 for circulating the supplementary plating bath in the aging tank 44, a pump 54 and an automatic valve 58 provided on the circulating path, and a supply path 60 which extends from the automatic valve 58 and feeds the supplementary plating bath to the coating tank 10. When the level of the supplementary plating bath in the aging tank 44 exceeds a lower limit level, the level detector 40 detects it to produce a detecting signal which in turn drives the pump 56. The automatic valve 58 is opened at a predetermined time point, and is closed by a signal from the level detector 40 which operates when the supplementary plating bath in the aging tank 44 falls to a given lower limit level. The avove mentioned time point indicates the time point when a given number of articles have been coated in the coating tank 10. The time point also indicates when the counter 62 for counting the number of the articles already coated has completed its counting of a given number of the articles. The automatic valve 58 is opened by a signal issued from the counter 62 at this time. The amount of the powder consumed, i.e. reduced in the coating tank 10 till the operating point of the automatic valve 58 is caluclated as a product of the number of the articles already coated and an amount of powder consumed for each article (previously obtained by an experiment or calculation). The timer 42 is previously set in order that powder of the amount corresponding to the product is fed from the powder supply 28 to the mixing tank 24.

In operation, the counter 62 and the timer 42 are first set, so that the counter 62 produces a signal when counted a predetermined number of the articles and timer 42 actuates to supply powder of an amount corresponding to the number of articles from the powder supply unit 28 to the mixing tank 24. Then, the electrophoretic powder coating operation is started in the coating tank 10. At this time, if the supplementary plating bath does not yet reach the upper limit level in the mixing tank 24, the level detector 22 operates to produce a signal. The signal then drives the automatic valve 18 to open, with the result that a part of the plating bath in the coating tank 10 is transferred into the mixing tank 24. When the plating bath exceeds a given lower limit level in the mixing tank 24, the plating bath is guided from the mixing tank 24 into the aging tank 44 by the powder dispersion unit 46. When the plating bath reaches the upper limit in the mixing tank 24, the output signal derived from the level detector 22 closes the automatic valve 18 to stop the supply of the plating bath from the coating tank 10 to the mixing tank 24. At this time, the plating bath in both the tanks 24 and 44 are agitated by the agitators 26 and 48 and the plating bath is transferred from the mixing tank 24 to the aging tank 44 through a path 46a by means of the powder dispersion unit 46 and then it is returned to the mixing tank 24 through the overflow path 50. When the level detector 40 detects that the supplementary plating bath in the aging tank 44 reaches the upper limit level during its circulating of the plating bath, the level detector 40 produces an output signal and the output signal drives the motor 36 of the powder supply 28 so that the feed screw 38 operates to feed powder into the mixing tank 24. The powder supplied to the mixing tank 24 is poured into the plating bath circulating by means of the agitator 26 in the mixing tank 24. While being dispersed in the plating bath, it flows from the mixing tank 24 through the powder dispersion unit 46 into the aging tank 44. When the plating bath leaves the powder dispersion unit 46, the powder is more uniformly dispersed in the plating bath. The plating bath thus supplied with powder will be referred to as supplementaly plating bath. In this manner, specified amount of powder is supplied and the timer 42 operates to stop the operation of the powder supply unit 28. The supplemenatry plating bath circulates through a path of the powder dispersion unit 46, the aging tank 44 and the mixing tank 24. Through this circulation, the supplementary plating bath is agitated in both the tanks so that the powder in the supplementary plating bath remains dispersed without sedimentation. During this circulation, the powder is well aged or wetted with the binder in the supplementary plating bath.

During the circulation of the supplementary plating bath, the coating work is progressively executed and the work of a given number of the articles is completed and the counter 62 counts the number of the articles. At this time, the counter 62 produces an output signal to open the automatic valve 58. As a result, the supplementary plating bath containing much powder in the aging tank 44 is supplied into the coating tank 10 by the action of the pump 56.

Then, when the supplementary plating bath in the aging tank 44 is exhausted up to the lower limit level, one cycle of the powder supply operation is completed and immediately the counter 62 is reset in preparation for the next coating work. At this time, the automatic valve 18 is again opened as described above to permit a part of the plating bath to flow out of the coating tank 10. And powder is dispersed into the plating bath and is sufficiently agitated, aged and circulated, as in the previous case. When the supplementary plating bath in the aging tank 44 is supplied into the coating tank 10, the supplementary plating bath also is fed from the mixing tank 24 through the powder dispersion unit 46 into the aging tank 44. In this case, however, as the rate of flow of the plating bath is much less than that of the plating bath to the coating tank 10, the effect by the plating bath supplied through the powder dispersion unit 46 is negligible. The steps following the supply of powder into the plating bath is as described previously.

As seen from the foregoing description, in the method for supplying powder into the coating tank and its apparatus, when a part of the plating bath is taken out from the coating tank, then suppling the powder of the amount corresponding to its consumed amount into the plating bath, uniform dispersion of the powder in the plating bath and sufficient aging of the plating bath are performed, and the part of the plating bath is maintained in this state. Further, such plating bath is supplied into the coating tank at a predetermined time. Therefore, it is possible to supply powder of much the same amount as the consumed powder amount, without partially gathering of powder. The powder supplied may also be aged in the plating bath in the coating tank. As a consequence, smooth operation for electrophoretic powder coating is performed continuously.

What we claim is:

1. A method for supplying powder into a coating tank for electrophoretic powder coating comprising:

a first step of taking out a specified amount of plating bath from the coating tank, in which plating bath the electrophoretic powder is reduced as a result of coating work;

a second step including: supplying powder of much the same amount as the reduced amount of the powder to the plating bath taken out from the coating tank; agitating the taken out plating bath while supplying the powder to form a supplementary plating bath; and carrying out a first dispersion of the powder in the supplementary plating bath;

a third step including: carrying out a second dispersion of the powder in the supplementary plating bath to form a further uniformly dispersed state; and aging the supplementary plating bath with the dispersed powder therein; and a fourth step of supplying to the coating tank sufficiently aged supplementary plating bath which is obtained from said third step and which has a high density of powder substantially uniformly dispersed therein.

2. A method according to claim 1, in which the third step comprises the steps of feeding the plating bath of which the powder is subjected to the first dispersion in said second step to a powder dispersion unit; and guiding the supplementary plating bath passed through said powder dispersion unit again to said powder dispersion unit while agitating said plating bath.

3. Apparatus for supplying powder to a coating tank for electrophoretic powder coating comprising:

a plating bath taking-out means for taking out a specified amount of plating bath from a coating tank, of which the electrophoretic powder contained therein is reduced as a result of coating work;

a mixing tank for receiving plating bath taken out from the coating tank;

an agitator provided on said mixing tank;

a powder supply unit for gradually supplying powder of the amount to be supplied into the plating bath in said mixing tank to form a supplementary plating bath;

a powder dispersion unit for receiving the supplementary plating bath in said mixing tank and more uniformly dispersing the powder contained in the supplementary plating bath;

an aging tank which receives the supplementary plating bath delivered through said powder dispersion unit and reserves said plating bath while agitating it, so as to sufficiently aging the powder in the supplementary plating bath; and a duct means for supplying aged supplementary plating bath from said aging tank into said coating tank at a predetermined time.

4. An appratus according to claim 3, in which said aging tank and said mixing tank are connected by a first communicating path with said powder dispersion unit and a second communicating path for returning the supplementary plating bath delivered through said first communicating path, whereby the supplementary plating bath is reserved in said aging tank in which a predetermined amount of supplementary powder is sufficiently dispersed and fully aged.

* * * * *